US005560176A

United States Patent [19]

Levo

[11] Patent Number: 5,560,176

[45] Date of Patent: Oct. 1, 1996

[54] PREFABRICATED STEEL–CONCRETE COMPOSITE BEAM

[75] Inventor: Pertti Levo, Lahti, Finland

[73] Assignee: Deltatek Oy, Lahti, Finland

[21] Appl. No.: 448,548

[22] PCT Filed: Jan. 10, 1994

[86] PCT No.: PCT/FI94/00010

§ 371 Date: Jul. 7, 1995

§ 102(e) Date: Jul. 7, 1995

[87] PCT Pub. No.: WO94/16169

PCT Pub. Date: Jul. 21, 1994

[30] Foreign Application Priority Data

Jan. 13, 1993 [FI] Finland ..... 930137

[51] Int. Cl.[6] ..... E04C 3/20

[52] U.S. Cl. ..... 52/724.1; 52/724.2; 52/724.3; 52/731.1; 52/737.1; 52/414; 52/223.8

[58] Field of Search ..... 52/724.1–724.3, 52/721.1, 731.1, 737.1, 730.2, 414, 334, 378, 223.8, 250–260, 320–341

[56] References Cited

U.S. PATENT DOCUMENTS

| | | | |
|---|---|---|---|
| 766,899 | 8/1904 | Pohlmann | 52/724.2 |
| 963,734 | 7/1910 | Morrill | 52/724.1 X |
| 1,235,636 | 8/1917 | Bagnall et al. | 52/414 X |
| 3,110,049 | 11/1963 | Nagin | 52/334 |
| 3,302,348 | 2/1967 | Pratt | 52/223.8 |
| 3,528,209 | 9/1970 | Schillinger | 52/223.8 |
| 5,426,096 | 6/1995 | McCracken | 52/730.4 X |

FOREIGN PATENT DOCUMENTS

| | | | |
|---|---|---|---|
| 0204238 | 7/1989 | Austria | 52/724.3 |
| 0292449A2 | 11/1988 | European Pat. Off. . | |
| 2329943 | 1/1975 | Germany | 52/724.3 |
| 0742629 | 12/1955 | United Kingdom | 52/724.1 |
| WO90/12173 | 10/1990 | WIPO . | |

*Primary Examiner*—Robert Canfield

*Attorney, Agent, or Firm*—Burns, Doane, Swecker & Mathis LLP

[57] ABSTRACT

The invention relates to a prefabricated steel/ concrete composite beam arranged to act together with concrete as a load-bearing composite structure for various slab assemblies and having two web portions (1) and horizontal projecting flange portions (2) extending outside the web portions, the web portions (1) being positioned with a mutual spacing side by side and interconnected at one edge of each web portion (1) by means of a horizontal top portion (3), and the web portions (1) and the horizontal top portion (3) being arranged to define a space which can be filled with concrete (4). To improve the properties of the beam, at least one plate-like member (5)is disposed substantially vertically in the space defined between the web portions (1) and the horizontal top portion (3), the plate-like member being provided with openings (6) positioned with mutual spacings successively in the longitudinal direction of the beam, and being attached at the upper edge to the lower surface of the horizontal top portion (3).

7 Claims, 1 Drawing Sheet

PREFABRICATED STEEL–CONCRETE COMPOSITE BEAM

BACKGROUND OF THE INVENTION

1. Field of the Invention

The invention relates to a prefabricated steel/ concrete composite beam arranged to act together with concrete as a load-bearing composite structure for various slab assemblies.

2. Discussion of the Related Art

The invention concerns a beam utilizing a steel beam/ concrete composite structure. Such beams are today well-known in element structures. One example of the prior art is the solution described in Finnish Patent Application 882 186. The composite structure makes the steel beam lighter, and the beam can be used over longer span lengths than what has been possible previously. The steel beam according to Finnish Patent Application 882 186 reduces the amount of welding work as the beam is made of profile sections preformed by hot rolling. However, the beam structure according to Finnish Patent Application 882 186 is complicated to manufacture as connecting pieces by means of which the composite structure is achieved increase the amount of welding. The handling of a plurality of small pieces as such complicates the manufacture of the beam.

Another example of the prior art is the solution disclosed in Finnish Published Specification 85 745, which eliminates the drawbacks of the solution disclosed in Finnish Patent Application 882 186. A drawback of Finnish Patent Application 85 745, however, is that if the solution is applied without a lower flange or without a fire-proof lower flange, the strength of the structure will not be the best possible in the case of fire. A similar situation occurs when the strength of the lower flange deteriorates significantly during a fire. The concrete contained in the beam thereby tends to be squeezed out, and the structure will not operate in a desired manner.

An object and summary provide a prefabricated steel/ concrete composite beam which eliminates the drawbacks of the prior art. This is achieved by means of a beam according to the invention which is characterized in that at least one plate-like member is disposed substantially vertically in the space defined between the web portions and the horizontal top portion, the plate-like member being provided with openings positioned with mutual spacings successively in the longitudinal direction of the beam, and being attached at the upper edge to the lower surface of the horizontal top portion.

An advantage of the prefabricated beam according to the invention is mainly that the extrusion of concrete out of the beam is prevented e.g. when the lower flange has lost its ability to operate at high temperatures. Another advantage is that the invention is simple and therefore advantageous to take into use. Still another advantage of the invention is its versatility as it can be used both with prestressed beams and with beams that have not been prestressed.

BRIEF DESCRIPTION OF THE DRAWINGS

In the following the invention will be described in greater detail with reference to the preferred embodiments shown in the attached drawings, in which.

DETAILED DESCRIPTION OF THE PREFERRED EMBODIMENTS

Figures 1, 2, 3, 4:
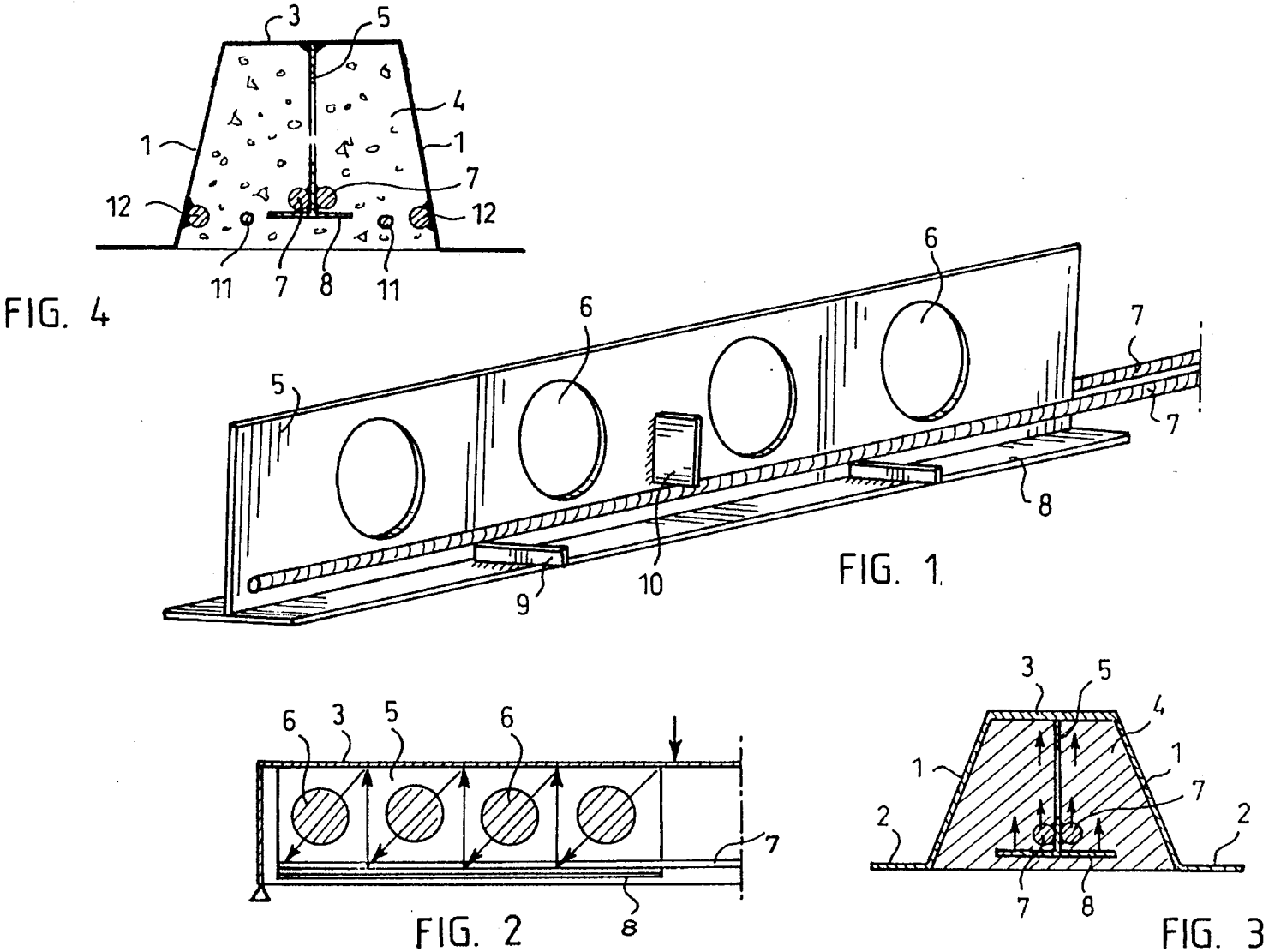
FIG. 1 is a general perspective view of a steel portion of a beam according to the invention.
FIG. 2 is a side view of a beam according to the invention.
FIG. 3 is a cross-sectional view of the beam shown in FIG. 2.
FIG. 4 is a cross-sectional view of another preferred embodiment of a beam according to the invention.

FIGS. 1 to 3 show one preferred embodiment of the beam according to the invention. The figures illustrate a prefabricated beam arranged to act together with concrete as a load-bearing composite structure in various slab assemblies. The beam comprises two web portions 1 and horizontal projecting flange portions 2 extending outside the web portions. The web portions 1 are positioned with a mutual spacing side by side and interconnected at one edge of each web portion by means of a horizontal top portion 3. The web portions 1 and the horizontal top portion 3 are arranged to define a space which may be filled with concrete 4. The web portions 1 may be positioned either in an inclined position or perpendicularly with respect to the projecting flange portions in such a manner that they incline towards each other at the upper or lower edge, or are in parallel with each other in adjacent parallel planes.

The operation of the beam described above as a composite structure is fully obvious to one skilled in the art, and therefore will not be described in greater detail herein. Finnish Published Specification 85 745, for instance, is referred to for more detailed information.

It has, however, been found that, when the solution disclosed e.g. in Finnish Published Specification 85 745 is used without the lower flange, that is, without the flange interconnecting the lower edges of the web portions 2, the concrete contained in the beam tends to be squeezed out, and the structure will not operate in a desired manner. A similar situation occurs e.g. when the lower flange has lost its ability to operate at high temperatures. The extrusion of concrete out of the beam takes place especially at the ends of the beam, where the force causing the phenomenon is at its greatest.

The object of the invention is to provide a solution by means of which this disadvantageous phenomenon is eliminated. An essential feature of the invention is that at least one plate-like member 5 is disposed substantially vertically in the space defined by the web portions 1 and the horizontal top portion 3. The member 5 is provided with openings 6 positioned with mutual spacings successively in the longitudinal direction of the beam. The plate-like member 5 is attached at the upper edge to the lower surface of the horizontal top portion 3. The plate-like member 5 appears clearly from FIG. 1 in particular; its position in the beam appears from FIGS. 2 and 3.

The plate-like member 5 may extend over the entire length of the beam, but it has proved to be especially advantageous to use two members 5 positioned at each end of the beam, i.e. at points where the disadvantageous extrusion of concrete is most problematic. The plate-like member 5 may extend from the beam ends e.g. over a length of 1 to 1.5 m, depending on the length of the beam and the loads. It is also possible to position a plurality of, e.g. two, three, etc. plate-like members in parallel with each other at the beam ends, if this is regarded as necessary. Correspondingly, the beam may have a plurality of, e.g. two, three, etc., parallel plate-like members extending over the entire length of the beam.

The tension reinforcement of the lower surface of the beam may also be anchored in the plate-like member 5. The tension reinforcement of the lower surface may comprise e.g. means 7 of concrete steel attached to the area of the lower edge of the plate-like member, an additional plate 8 attached to the lower edge of the member 5, etc.

The composite effect between the plate-like member 5 and concrete may be made more efficient by using various additional stops 9, 10. The additional stops may be made of any suitable material, e.g. sheet, deformed reinforcement bar, etc.

In the beam according to the invention the plate-like member 5 also acts as vertical reinforcement and as anchoring means for tension reinforcement, as mentioned above. The plate-like member thus has the following properties essential for the operation of the structure: the plate-like member 5 keeps the concrete contained in the beam together, acts as vertical reinforcement, anchors tension reinforcement, and improves the co-operation between concrete and steel.

The operation of the plate-like member 5 may be illustrated by a so-called truss analogue. The truss analogue means that forces that will act on the different portions of the truss are calculated when the structure is being designed. Co-operation between the different portions requires that the structure will keep together. This means, among other things, that the tension reinforcement is anchored properly at the beam end and that the concrete contained in the beam will not be squeezed out. When the lower flange of the steel beam acts as the tension reinforcement of the lower surface of the composite beam, it operates integrally with the rest of the beam and is as such firmly anchored in the beam end, thus also preventing the extrusion of concrete. The webs, upper flange and concrete operate as described e.g. in Finnish Published Specification 85 745.

FIG. 2 illustrates the operation of the plate-like member 5 by utilizing the truss analogue. An oblique compression force acting on the concrete diagonal is anchored in the openings 6 of the member 5 and the concrete steels 7 provided at the lower edge of the member 5, the additional plate 8 and the other possible additional stops 9, 10. The solid portions of the plate-like member 5 between the openings 6 act as vertical reinforcement. The tension reinforcement acting as the lower flange is anchored in the lower edge of the plate-like member 5. The top flange 3 and the concrete 4 act as the upper flange.

FIG. 4 shows another preferred embodiment of the beam according to the invention. The embodiment of FIG. 4 corresponds essentially to the embodiment of FIGS. 1 to 3. The same reference numerals as in FIGS. 1 to 3 are used at corresponding points in FIG. 4. An essential difference between the embodiment of FIGS. 1 to 3 and that of FIG. 4 is that the beam shown in FIG. 4 is prestressed. The prestressing increases the capacity of the beam significantly. Prestressing steels are indicated in FIG. 4 by the reference numeral 11. The reference numeral 12 indicates concrete steels that ensure cooperation with concrete.

Both of the two embodiments described above can be advantageously prefabricated into completed beams, i.e. the steel portions are machined, concrete is cast into the space between the web portions and the top portion, etc., at the factory, which is of advantage as it reduces the work to be carried out outdoors at the construction side. Also, a better result will be obtained in this way.

The embodiments described above are not intended to limit the invention in any way, but the invention may be modified within the scope of the claims as desired. Accordingly, it is obvious that the beam according to the invention or its details need not necessarily be such as shown in the figures but other solutions are possible as well. For instance, the additional stops may be completely different from those shown in the figures. The web portions, projecting flange portions and horizontal top portion may also be formed in any suitable way, for instance, as described in Finnish Published Specification 85 745, etc. The embodiments shown in the figures are so-called open composite beams, i.e. the beams have no lower flange interconnecting the lower edges of the web portions. However, the invention is not limited to this type of beam, but it may also be applied in beams having the lower flange, as already mentioned above with reference to fire situations.

I claim:

1. A prefabricated steel/concrete composite beam, comprising:

two steel web portions;

a steel horizontal projecting flange portion extending outside each web portion;

the web portions being positioned with a mutual spacing side by side;

a steel horizontal top portion interconnecting one edge of each web portion;

the web portions and the horizontal top portion being arranged to define a space filled with concrete;

at least one plate-like member disposed substantially vertically in the space defined between the web portions and the horizontal top portion;

the plate-like member being provided with openings positioned with mutual spacings successively in a longitudinal direction of the beam, and being attached at an upper edge to a lower surface of the horizontal top portion.

2. Steel/concrete composite beam according to claim 1, wherein at least one plate-like member is provided in an area of each end of the beam.

3. Steel/concrete composite beam according to claim 1, wherein the at least one the plate-like member arranged to extend over an entire length of the beam.

4. Concrete/steel composite beam according to claim 1 further comprising tension reinforcement on a lower surface of the beam anchored to the at least one plate-like member.

5. Concrete/steel composite beam according to claim 4, wherein the tension reinforcement comprises means made of reliar.

6. Concrete/steel composite beam according to claim 4, wherein the tension reinforcement comprises an additional plate.

7. Concrete/steel composite beam according to claim 6, wherein the additional plate is attached to a lower edge of the at least one plate-like member.

* * * * *